United States Patent [19]

Hinterholzer

[11] 4,174,114

[45] Nov. 13, 1979

[54] CROSSOVER PREVENTER FOR SKIS

[76] Inventor: Hans Hinterholzer, 5759 Saalbach, Land Salzburg, Austria

[21] Appl. No.: 898,417

[22] Filed: Apr. 20, 1978

[51] Int. Cl.[2] ..... A63C 11/00

[52] U.S. Cl. ..... 280/11.37 E

[58] Field of Search ..... 280/611, 11.37 R, 11.37 E, 280/11.37 J, 11.37 T, 11.37 G, 604

[56] References Cited

U.S. PATENT DOCUMENTS

| | | | |
|---|---|---|---|
| 3,953,043 | 4/1976 | Hinterholzer | 280/11.37 E |
| 4,047,726 | 9/1977 | Koleisl | 280/11.37 E X |

FOREIGN PATENT DOCUMENTS

| | | | |
|---|---|---|---|
| 2516194 | 10/1976 | Fed. Rep. of Germany | 280/11.37 E |

*Primary Examiner*—Joseph F. Peters, Jr.
*Assistant Examiner*—Gene A. Church
*Attorney, Agent, or Firm*—Karl F. Ross

[57] ABSTRACT

A crossover preventer for skis comprises a base plate adapted to be mounted upon the upper surface of a ski and provided with an upwardly swingable barrier which, in its upright position, forms a stop to prevent overcrossing of one ski above the other. The barrier-forming element is swingably mounted on the base plate via a carrier body which is rotatable and shiftable relative to the base plate.

8 Claims, 6 Drawing Figures

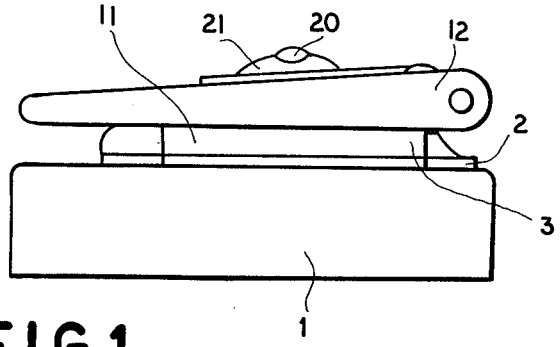
FIG. 1
FIG. 2
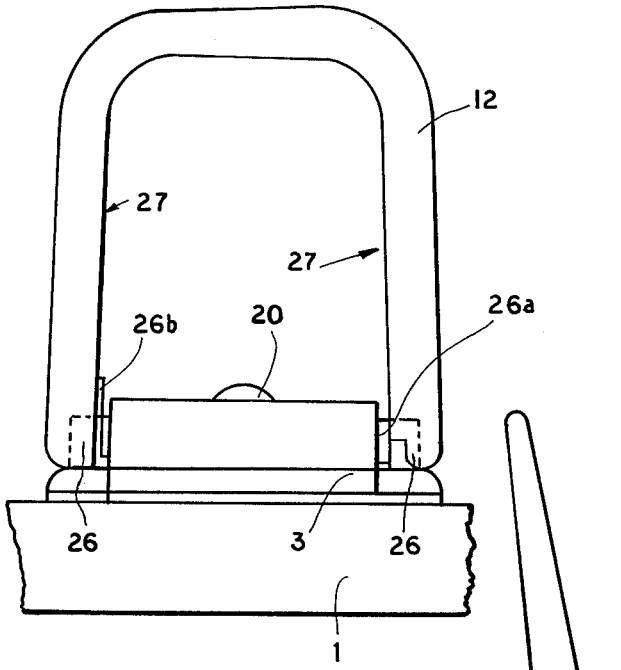
FIG. 5
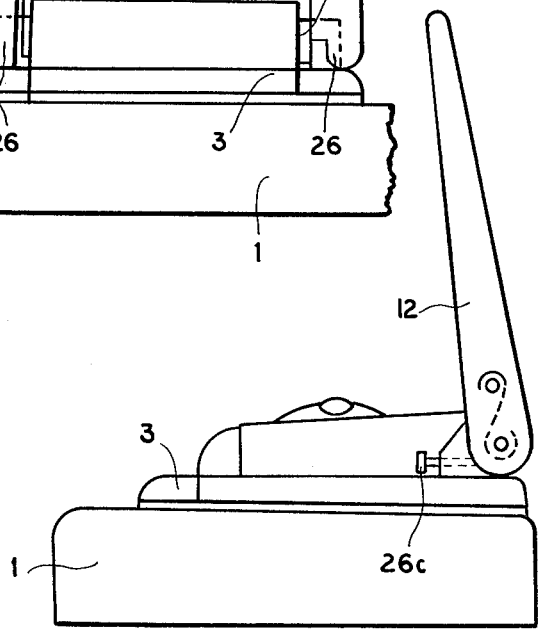

CROSSOVER PREVENTER FOR SKIS

FIELD OF THE INVENTION

The present invention relates to a device for preventing crossover of a pair of skis during skiing and, more particularly, to a barrier device provided on the upper surface of each ski and swingable into an upright position to prevent crossover of one ski above the other during skiing.

BACKGROUND OF THE INVENTION

A prior development in this field is disclosed in U.S. Pat. No. 3,953,043 which describes an anticrossing device for a ski which comprises a base plate having a bent barrier member which is pivotally mounted in the base plate and is swingable into an upright position to prevent overcrossing of one ski by the other in one direction while permitting a crossed ski to be displaced back into a proper position by deflection of the barrier member.

The bow-shaped barrier member is spring-biased on this base plate into its upright position but is deflectable against the force of the spring to permit uncrossing of the skis.

The barrier member, in its opposite state, lies parallel to a longitudinal edge of the ski, usually the inner longitudinal edge, and detent means is provided to allow, by axial displacement of the barrier member along its pivot axis, the barrier member to be swung downwardly into an inoperative position in which it is retained.

While this device has been found to be effective for most purposes, it must be mounted at a fixed location on each ski of a pair so that the device is not suitable for all types of skis or for interchangeable mounting upon right and left skis as required.

OBJECT OF THE INVENTION

It is, therefore, an object of the present invention to provide an improved anticrossing device for skis which can avoid the aforementioned disadvantage and which permits the device to be interchangeably mounted on right and left skis and, more generally, upon skis of all types.

SUMMARY OF THE INVENTION

These objects and others which will become apparent hereinafter are attained, in accordance with the present invention, in an anticrossing device for skis which comprises a bow-shaped anticrossing member, i.e. a barrier member which is swingable relative to a base plate adapted to be fixed to the upper surface of a ski against the force of a spring so that the spring retains the barrier member yieldably against an abutment, thereby permitting deflection of the barrier member in one direction transversely of the ski to permit uncrossing of a pair of skis, while preventing or hindering any tendency toward crossover in the opposite direction.

In the operative position of the device, the barrier is to be swingable about an axis parallel to a longitudinal edge of the ski and preferably proximal to this longitudinal edge. In the improvement of the present invention, the device comprises a base plate which is fixedly mounted on the upper surface of the ski and carrying a support body which is rotatable and shiftable on this base plate but which is fixed thereto so as to be incapable of being withdrawn from the base plate. The bow-shaped barrier member, in turn, is spring-loaded and swingable on this support body which is formed with the abutment against which the spring means urges the barrier member in its upright position.

According to an important feature of the invention, the support member or body is provided on the base plate and is associated with indexing means for fixing the support body in three positions. Two of these positions orient the pivot axis parallel to the longitudinal edges of the ski while the other position orients the pivot axis of the barrier member transverse to the longitudinal axis and longitudinal edges of the ski.

Such an arrangement has the important advantage that one and the same anticrossing device can be used for all ski configurations independently of whether the ski is a left ski or a right ski.

According to another feature of the invention, the support body has a flat or plate shape and is provided with a longitudinal opening or slot in which a bearing disk of approximately circular configuration is engaged, this bearing disk being secured to the base plate. On the underside of the plate-shaped support body, there is provided an indexing pin, an indexing bolt or the like which is adapted to be fitted selectively into one of three indexing recesses formed in the base plate, these recesses lying along a substantially semicircular groove or channel which is coaxial to the bearing disk and the axle (pivot axis) defined thereby.

BRIEF DESCRIPTION OF THE DRAWING

The above and other objects, features and advantages will become more readily apparent from the following description, reference being made to the accompanying drawing in which:

FIG. 1 is a side-elevational view of an anticrossing device in accordance with the present invention, the bow-shaped barrier member being illustrated in its downwardly swung inactive position but with its axis parallel to the right-hand longitudinal edge of the ski;

FIG. 2 is an elevational view of the device as seen from the side of the ski along which the pivot axis is provided, with the bow-shaped barrier member in its upwardly swung position;

FIG. 5 is a side-elevational view of the device with the barrier member in its upwardly swung position.

SPECIFIC DESCRIPTION

To the upper surface of the ski 1, there is affixed by means of a double-backed adhesive plate 2, a base plate 3. Alternatively, the base plate 3 can be secured to the upper surface of the ski by screws.

Figure 3:
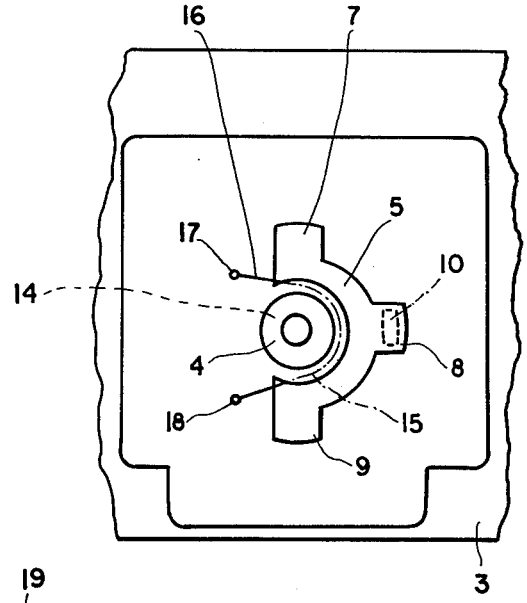
FIG. 3 is a plan view, the support body having been removed, of the base plate which is secured to the ski.

At the center of this base plate 3, there is provided an upstanding cylindrical boss 4 and coaxial therewith, a semicircular channel 5 extending over an arc length of about 180° as can be seen in FIG. 3. As is also apparent from FIG. 3, one end of this channel or groove 5 lies proximal to one longitudinal edge of the ski while the other end lies proximal to the other longitudinal edge of the ski, namely, the upper end lower longitudinal edges as seen in FIG. 3, respectively.

Indented from this channel 5 and at right angles to one another are a pair of recesses 7 and 9, reaching toward the respective longitudinal edges of the ski, and a recess 8 disposed along an axis of the device parallel to the longitudinal axis of the ski and lying midway along the channel 5. The recesses 7, 8 and 9 form indexing recesses for an indexing projection 10 in the form of a pin, protuberance or bolt which is formed on the underside of a support body 11. The indexing projection 10 is shown, in dot-dash lines in FIG. 3, to lie in the central indexing recess 8 although it can be swung into one of the terminal indexing recesses 7 and 9.

The indexing projection 10 is urged into one of the recesses 7, 8, 9 by a spring which is here shown to be a tension or torsion spring having a pair of wings 15, 16 which are fixed on pins 17 and 18 on the underside of the support body 11.

The coils of the spring 14 lie coaxial with the wall of the boss 4 so that the spring 14–16 is effective in all three of the positions of the indexing projection 10 to urge the projection 10 radially into the respective recesses 7, 8, 9.

Figure 6:
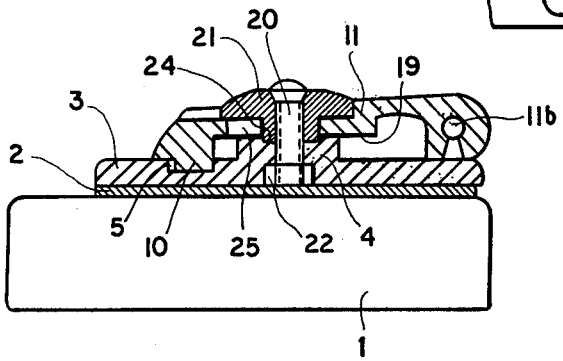
FIG. 6 is a cross-sectional view taken along the line VI—VI of FIG. 4.
Figure 4:
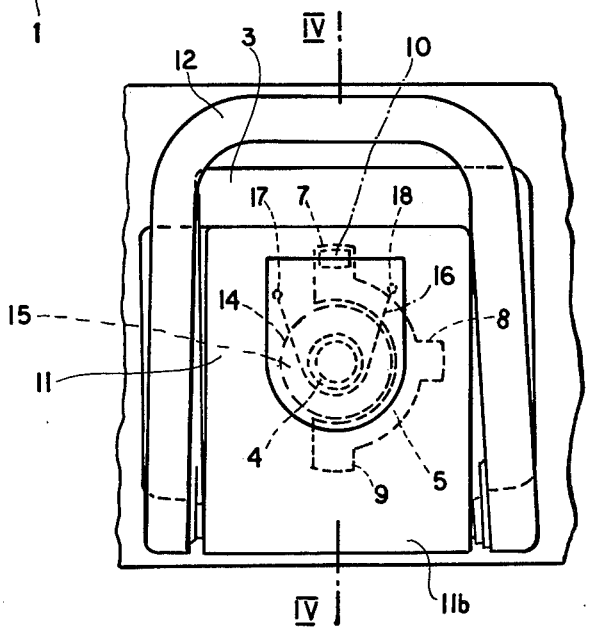
FIG. 4 is a plan view of the device showing the barrier member in its downwardly swung or inactive position and the support body in place.

The indexing projection 10 determines, depending upon the recess 7–9 in which it is lodged, the position of the axis of the stirrup-shaped barrier member 12. More specifically, the support body 11, which is generally flat and lies parallel to the base plate 3, is shiftable relative to this base plate radially with respect to the pivot pin 20 and the axis of the channel 5, this radial displacement being defined by the slot 25 which is formed in the body 11. The spring 14–16 urges the body 11 relative to the pin 20 so that the latter normally lies at one end of the slot (FIG. 6). In this position, the indexing projection 10 lies in one of the recesses 7, 8, 9. To reindex the body 11, the latter is displaced linearly and radially against the spring force to withdraw the indexing projection 10 from the recess in which it has been lodged. Thereupon the body 11 is rotated about the axis of pin 20 until the projection 10 is radially aligned with another recess 7, 8 or 9 and the spring urges the projection into the latter recess. When the projection is received in recess 8, the axis of the stirrup 12 lies transversely of the longitudinal axis and the longitudinal edges of the ski.

When the projection 10 is in either of the terminal recesses 7, 9, the axis lies proximal to a respective longitudinal edge of the ski and parallel thereto.

The support body 11 is thus centrally mounted on the base plate 3 by the threaded bolt forming the pin 20 and is held thereon by means of a washer or disk 21. The bolt 20 is threaded into the boss 4 of the base plate 3.

The washer or disk 21 is formed with a downwardly and inwardly extending boss 24, forming a journaling disk or ring which is guided in the elongated (oval) window or slot 25 of the body 11 which forms a roof or cover over the boss 4.

The lower ends 26 of the two shanks 27 of the stirrup 12 are journaled by a pin (pintle) **26*a* in a bearing block 11*b* formed along one edge of the support body 11. Furthermore, a torsion spring 26*b* biases this stirrup 12 into its upstanding position (FIG. 2) while means can be provided to retain the stirrup in its downwardly swung position (FIG. 1) as described in the aforementioned patent. A screw, diagrammatically represented at 26*c* can be provided to enable the inclination of the stirrup 12, in its upstanding position, to be adjusted (see FIG. 5**).

The device, apart from the indexing which has been described fully above, can operate in the manner set forth in the aforementioned patent.

In the transverse position of the axis of the stirrup, the support body 11 can have a recess in its upper surface adapted to receive the tip or point of a ski pole.

I claim:

1. An anticrossing device for a ski comprising:

a base plate adapted to be fixed on an upper surface of said ski;

a support body pivotally mounted on said base plate;

a stirrup-shaped barrier member swingably mounted on said support body and defining an axis therewith about which said barrier member is swingable into an upright position limiting crossing of skis;

spring means on said support body for biasing said barrier member into said upright position; and indexing means between said base plate and said support body for indexing said support body selectively in one of three positions, two of the indexable positions having said axis parallel to the longitudinal edges of the ski and the third indexable position having said axis transverse to said longitudinal edges.

2. The anticrossing device defined in claim 1 wherein said support body is shiftable relative to said base plate radially of its pivot axis, said device further comprising a spring urging said support body in one radial direction, said indexing means including spaced-apart recesses opening in radial directions and an indexing projection radially engageable in and removable from said recesses selectively.

3. The anticrossing device defined in claim 2 wherein said projection is formed on said support body and said recesses are formed in said base plate.

4. The anticrossing device defined in claim 3 wherein said base plate is formed with an upwardly open channel and said recesses extend radially from said channel, said projection extending downwardly from said support body into said channel.

5. The anticrossing device defined in claim 4 wherein said base plate is formed with a boss defining a pivot axis for said support body, and a pin received in said boss, said channel surrounding said pivot axis over an arc of about 180°, two of said recesses being formed at opposite ends of said arc and another recess being located substantially midway along said arc, said support body having an elongated opening receiving said pin.

6. The anticrossing device defined in claim 5 wherein said pin is provided with a washer overlying said support body and formed with a boss received in said opening and guiding said body on said pin.

7. The anticrossing device defined in claim 6 wherein the upper side of said body is formed with a recess adapted to receive the point of a ski pole.

8. The anticrossing device defined in claim 6 wherein said base plate is secured to said ski by an adhesive layer.

* * * * *